US010544646B2

(12) United States Patent
Webb et al.

(10) Patent No.: US 10,544,646 B2
(45) Date of Patent: Jan. 28, 2020

(54) DOWNHOLE BARRIER DELIVERY DEVICE

(71) Applicant: HALLIBURTON ENERGY SERVICES, INC., Houston, TX (US)

(72) Inventors: Earl Don Webb, Wilson, OK (US); Matthew Gabriel Eye, Duncan, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 164 days.

(21) Appl. No.: 15/754,070

(22) PCT Filed: Oct. 2, 2015

(86) PCT No.: PCT/US2015/053646
§ 371 (c)(1),
(2) Date: Feb. 21, 2018

(87) PCT Pub. No.: WO2017/058240
PCT Pub. Date: Apr. 6, 2017

(65) Prior Publication Data

US 2018/0252066 A1 Sep. 6, 2018

(51) Int. Cl.
*E21B 33/12* (2006.01)
*E21B 23/00* (2006.01)
*E21B 23/06* (2006.01)

(52) U.S. Cl.
CPC ..... *E21B 33/1208* (2013.01); *E21B 23/00* (2013.01); *E21B 23/06* (2013.01)

(58) Field of Classification Search
CPC ..... E21B 33/1208; E21B 41/00; E21B 33/16; E21B 33/1285; E21B 23/00; E21B 23/06; E21B 23/04; E21B 33/136; E21B 33/126
See application file for complete search history.

(56) References Cited

U.S. PATENT DOCUMENTS 2,969,839 A * 1/1961 Greene ..... E21B 33/136 166/63
2,978,029 A * 4/1961 True ..... E21B 23/065 166/63
3,489,216 A * 1/1970 Armstrong ..... E21B 33/13 166/126

(Continued)

OTHER PUBLICATIONS

Service Tools, Fas Drill® Frac Plug, Completion Tools, H06159, Jul. 2014, 3 pages, Halliburton, Houston, TX.

(Continued)

*Primary Examiner* — Michael R Wills, III
(74) *Attorney, Agent, or Firm* — Polsinelli PC

(57) ABSTRACT

A downhole barrier delivery device is provided including a tubular housing having an outer surface, a first end having a fluid entrance aperture, a second end opposite the first end having a fluid exit aperture, and an inner bore extending from the fluid entrance aperture to the fluid exit aperture. A bypass channel extends along the length of the tubular housing between the outer surface of the tubular housing and the inner bore, wherein the central bore and the bypass channel are separated by an impermeable barrier. A first end of the bypass channel is fluidly coupled with the inner bore via a first bypass port. A second end of the bypass channel is fluidly coupled with the inner bore via a second bypass port.

19 Claims, 11 Drawing Sheets

(56) References Cited

U.S. PATENT DOCUMENTS

| | | | | | |
|---|---|---|---|---|---|
| 3,623,550 | A * | 11/1971 | de Lajarte | E21B 33/136 | 166/125 |
| 3,891,034 | A | 6/1975 | Owen et al. | | |
| 4,491,178 | A * | 1/1985 | Terrell | E21B 33/134 | 166/192 |
| 4,671,356 | A * | 6/1987 | Barker | E21B 33/134 | 166/133 |
| 5,667,015 | A | 9/1997 | Harestad et al. | | |
| 6,009,216 | A | 12/1999 | Pruett et al. | | |
| 6,009,944 | A | 1/2000 | Gudmestad | | |
| 7,628,213 | B2 * | 12/2009 | Telfer | E21B 21/103 | 166/222 |
| 9,033,032 | B2 * | 5/2015 | Umphries | E21B 17/1028 | 166/244.1 |
| 2009/0008098 | A1 * | 1/2009 | Barbee, Jr. | E21B 33/16 | 166/325 |
| 2011/0048712 | A1 | 3/2011 | Barbee | | |
| 2011/0146986 | A1 | 6/2011 | Giem et al. | | |
| 2011/0303422 | A1 * | 12/2011 | Soni | E21B 23/04 | 166/386 |

OTHER PUBLICATIONS

International Search Report and Written Opinion; PCT Application No. PCT/US2015/053646; dated Jun. 29, 2016.

* cited by examiner

DOWNHOLE BARRIER DELIVERY DEVICE

CROSS-REFERENCE TO RELATED APPLICATIONS

This application is a national stage entry of PCT/US2015/053646 filed Oct. 2, 2015, said application is expressly incorporated herein in its entirety.

FIELD

The present disclosure relates generally to fluid barriers for wellbore plugging operations or fluid diversion operations. In particular, the subject matter herein generally relates to a downhole barrier delivery device for delivering a fluid barrier.

BACKGROUND

Wellbores are drilled into the earth for a variety of purposes including accessing hydrocarbon bearing formations. A variety of downhole tools may be used within a wellbore in connection with accessing and extracting such hydrocarbons. Throughout the process, it may become necessary to isolate sections of the wellbore as well as guide the direction of the wellbore.

Plugs may be used to isolate a section of the wellbore or provide guidance to redirect the wellbore. The plugs may be made of cement to create a hydraulic seal. The cement plug may be set on top of other wellbore fluids. Support tools may be used to prevent the cement from interacting with the wellbore fluid and assist in creating a hydraulic seal.

BRIEF DESCRIPTION OF THE DRAWINGS

Implementations of the present technology will now be described, by way of example only, with reference to the attached figures, wherein.

DETAILED DESCRIPTION

Figure 1:
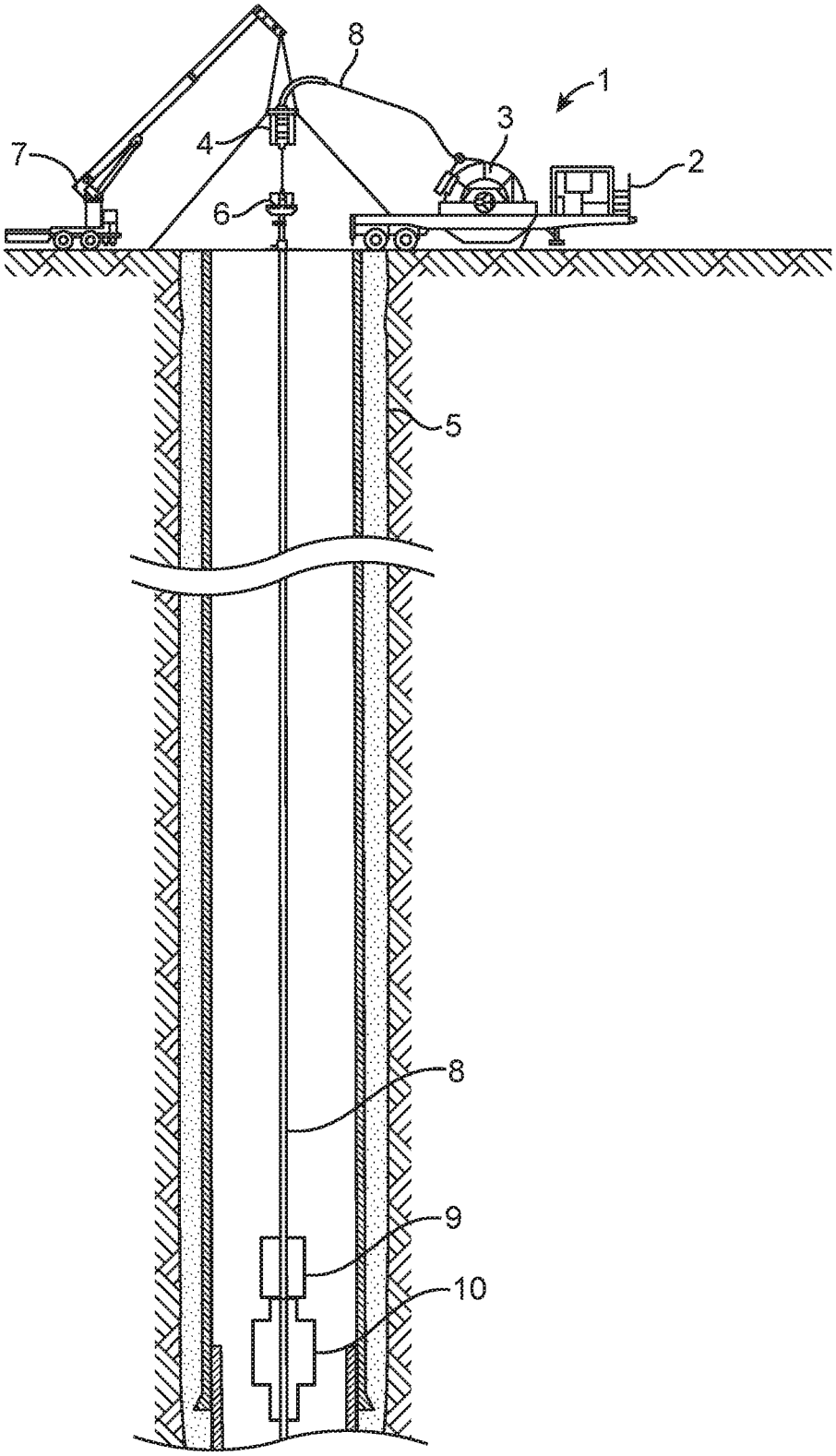
FIG. 1 is a diagram illustrating an exemplary environment for a delivery device according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

In the above description, reference to up or down is made for purposes of description with "up," "upper," "upward," "uphole," or "upstream" meaning toward the surface of the wellbore and with "down," "lower," "downward," "downhole," or "downstream" meaning toward the terminal end of the well, regardless of the wellbore orientation. Correspondingly, the transverse, axial, lateral, longitudinal, radial, etc., orientations shall mean orientations relative to the orientation of the wellbore or tool. The term "axially" means substantially along a direction of the axis of the object. If not specified, the term axially is such that it refers to the longer axis of the object.

Several definitions that apply throughout the above disclosure will now be presented. The term "coupled" is defined as connected, whether directly or indirectly through intervening components, and is not necessarily limited to physical connections. The connection can be such that the objects are permanently connected or releasably connected. The term "outside" or "outer" refers to a region that is beyond the outermost confines of a physical object. The term "inside" or "inner" refers to a region that is within the outermost confines of a physical object. The term "substantially" is defined to be essentially conforming to the particular dimension, shape or other word that substantially modifies, such that the component need not be exact. For example, "substantially cylindrical" means that the object resembles a cylinder, but can have one or more deviations from a true cylinder. The terms "comprising," "including" and "having" are used interchangeably in this disclosure. The terms "comprising," "including" and "having" mean to include, but not necessarily be limited to the things so described.

Disclosed herein is a delivery device to transport a fluid barrier to a desired location in a wellbore. The fluid barrier is utilized to separate liquids or other fluids and prevent flow past its position. For example, the fluid barrier can be used to help set a plug such as a cement plug for directional drilling, well control, zonal isolation, formation testing, or wellbore stability. Another application would be applicable to fluid diversion. An example would be pumping treatment fluid such as acid or solvent by using the fluid barrier to divert the treatment fluid into the zone of interest. The fluid barrier would prevent contamination of the treatment fluid with the wellbore fluid.

When transporting the delivery device downhole, fluid may be needed to, for example, removing cuttings from the well, washing ahead of the bottom hole assembly (BHA), and control corrosion in the wellbore. The delivery device can include bypass ports and a bypass channel such that fluid can circumvent the fluid barrier during transport in the wellbore. When the delivery device reaches a predetermined, desired location, a ball can be dropped to shift the fluid barrier out of the delivery device. As the fluid barrier exits the delivery device, the fluid barrier can expand such that the cement or treatment fluid and the wellbore fluid are separated. In setting a cement plug, the cement or treatment fluids may have a higher or lower density or viscosity than the fluid in the wellbore. As such, the fluid barrier can maintain the location and seal of the cement plug by preventing the cement plug or treatment fluid from sinking, slumping, or mixing with the wellbore fluid.

The downhole barrier delivery device can be deployed in an exemplary wellbore system 1 shown, for example, in FIG. 1. The wellbore system 1 is comprised of a vehicle 2 which supports a conveyance reel 3. The vehicle 2 can be a truck, a trailer, or any suitable platform to transport or support a conveyance reel 3. An injector head unit 4, which can be suspended by a crane 7, feeds and directs a conveyance 8 from the conveyance reel 4 into the subterranean formation by a wellbore 5. The conveyance 8 can be coiled tubing, joint tubing, or any other suitable tubular to convey a tool down a wellbore. Before passing into the wellbore 5, the conveyance 8 can pass through a blowout preventer 6. The conveyance 8 is coupled with a delivery device 10 by a connector 9. The connector 9 can be any suitable device to connect a tool or device to a conveyance 8. The conveyance 8 may be directly coupled with the delivery device 10.

It should be noted that while FIG. 1 generally depicts a land-based operation, those skilled in the art would readily recognize that the principles described herein are equally applicable to operations that employ floating or sea-based platforms and rigs, without departing from the scope of the disclosure. Also, even though FIG. 1 depicts a vertical wellbore, the present disclosure is equally well-suited for use in wellbores having other orientations, including horizontal wellbores, slanted wellbores, multilateral wellbores or the like. Further, the wellbore system 1 can have a casing already implemented while, in other examples the system 1 can be used in open hole applications.

Figure 2A:
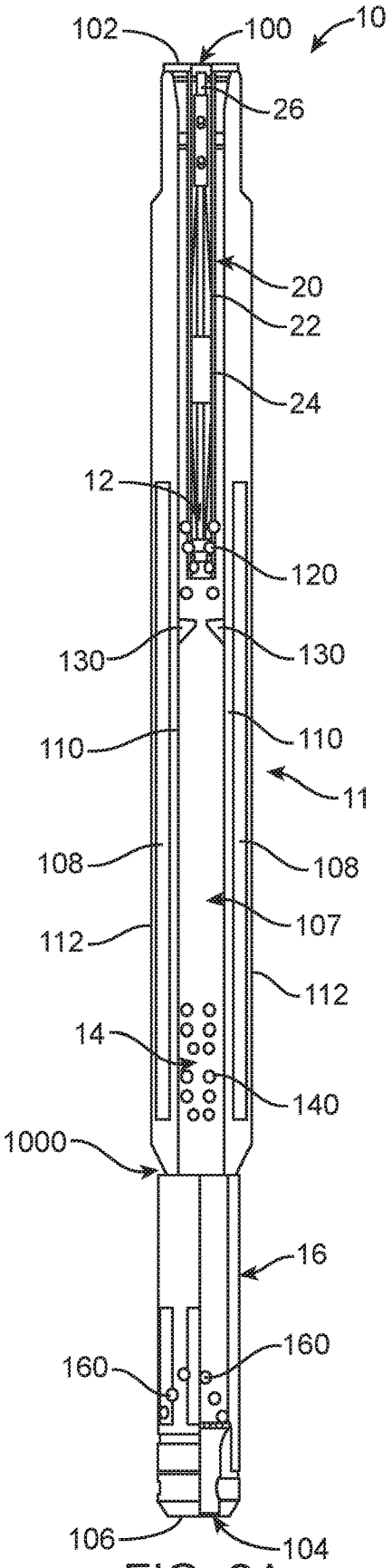
FIG. 2A is a diagram illustrating a fluid barrier being inserted into a delivery device.

FIG. 2A is a diagram of a delivery device 10. The delivery device 10 includes a tubular housing 11. The tubular housing 11 includes an outer surface 112, a first end 100 having a fluid entrance aperture 102, a second end 104 opposite the first end 100 having a fluid exit aperture 106. The inner bore 107 of the tubular housing 11 extends from the fluid entrance aperture 102 to the fluid exit aperture 106 such that the fluid entrance aperture 102 and the fluid exit aperture 106 are in fluid communication with each other. The tubular housing 11 can have a cylindrical shape. In other examples, the tubular housing 11 can have the shape of a rectangular prism, a hexagonal prism, or any other suitable shape.

The delivery device 10 also includes a bypass channel 108. The bypass channel 108 extends along a longitudinal length of the tubular housing 11 between the outer surface 112 of the tubular housing 11 and the surface of the inner bore 107. The bypass channel 108 can be a linear channel, or may be arcuate or form a partial ring encircling a portion of the inner bore 107. The inner bore 107 and the bypass channel 108 are separated by an impermeable barrier 110. The surface or wall of the inner bore 107 may form the impermeable barrier 110. The impermeable barrier 110 is set parallel to the longitudinal direction inner bore 107 thereby blocking the substantial entirety of the cross-sectional area of the inner bore 107 to prevent fluid flow therethrough. The impermeable barrier 110 can be metal, composite, phenolic, thermal set plastic, or any suitable material to prevent fluid from passing between the inner bore 107 and the bypass channel 108. The impermeable barrier can be made of the same material as the tubular housing 11.

The tubular housing 11 includes a first bypass port 12 and a second bypass port 14. The first bypass port 12 and the second bypass port 14 include one or more holes 120, 140 and permit fluid communication between the inner bore 107 with the bypass channel 108. The first bypass port 12 fluidly couples the first end of the bypass channel 108 with the inner bore 107, the first bypass port 12 being positioned toward or proximate to the first end 100 of the tubular housing 11. The second bypass port 14 fluidly couples the second end of the bypass channel 108 with the inner bore 107, the second bypass port being positioned toward or proximate to the second end 104 of the tubular housing 11. The first bypass port 12, the second bypass port 14, and the bypass channel 108 are in fluid communication such that fluid can flow from the inner bore 107, through the first bypass port 12 into the bypass channel 108. The fluid can pass through the bypass channel 108 and through the second bypass port 14 into the inner bore 107. As such, the fluid can bypass a section of the inner bore 107. In other examples, the fluid can flow from the inner bore 107 into the bypass channel 108 through the second bypass port 14 and out of the bypass channel 108 by the first bypass port 12. Thus, fluid can flow in either direction through the tubular housing 11.

The tubular housing 11 can also include an exit port 160 that include one or more holes. The exit port 160 can permit fluid communication between the inner bore 106 and the environment such that fluid would flow out of the delivery device 10. The exit port 160 can be closer to the second end 104 of the tubular housing 11 than the second bypass port 14.

The tubular housing 11 also includes at least one conditional operator 130. The conditional operators 130 can be a singular part or a multipart device. The conditional operators 130 extend into the inner bore 107 and bear a load. The conditional operators 130 are configured to shear off or detach when a breaking force is imparted on the conditional operators 130 from the tubular housing 11 into the inner bore 107. The breaking force is a force large enough such that the conditional operator(s) 130 detach or shear off from the tubular housing 11 into the inner bore 107. In some instances, the conditional operators 130 can be shear pins, lock rings, collets, or any other suitable mechanical detail that detaches from the tubular housing 11 when a breaking force is applied. The breaking force can be applied by a sleeve (shown in FIG. 4).

The tubular housing 11 can be coupled with a diverter 16 by connection 1000. The tubular housing 11 can be coupled with the diverter 16 by any suitable fastening means, for example by threaded engagement. The diverter 16 can include an exit port 160 that include one or more holes. The exit port 160 can permit fluid communication between the inner bore 107 and the environment such that fluid would flow out of the delivery device 10 through the exit port 160 or the fluid exit aperture 106.

Figure 2B:
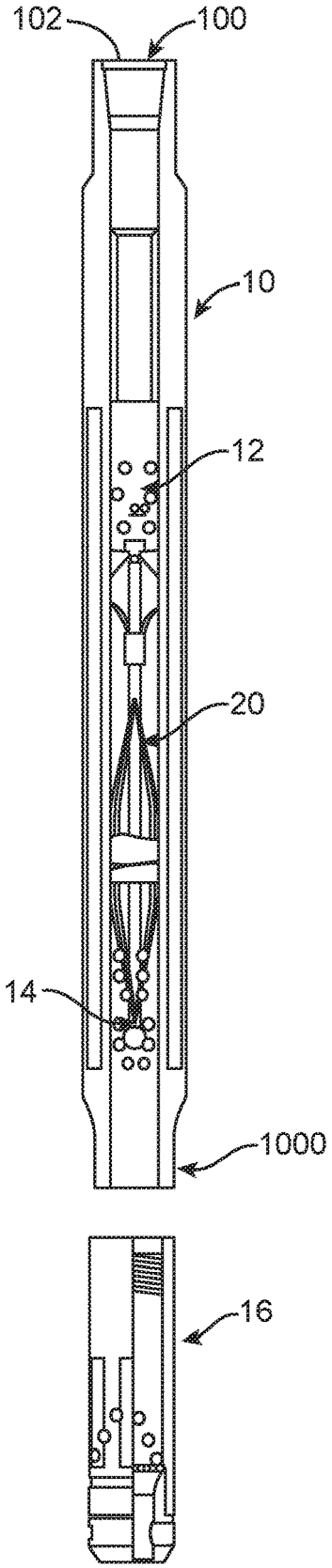
FIG. 2B is a diagram illustrating another embodiment of a fluid barrier being inserted into a delivery device.

A fluid barrier 20 can be inserted into the inner bore 107 through the fluid entrance aperture 102 of the delivery device 10. In other examples, the diverter 16 can be removed, and the fluid barrier 20 can be inserted into the inner bore 107 through the connection 1000, as shown in FIG. 2B. The fluid barrier 20 has a plurality of slats 22. The plurality of slats 22 are configured to expand radially outward. In particular, the slats 22 are tensioned such that the slats 22 are biased to expand radially outward. The slats 22 can be spring loaded or otherwise biased for expansion. Accordingly, with sufficient force, the slats 22 can be pushed radially inward (to be inserted in the delivery device 10) and then expand when released. The slats 22 can be made of resilient materials such as, for example, spring steel or any other material suitably resistant to the environment within the downhole region of the wellbore.

One or more impermeable membranes 24 are coupled with the slats 22. The impermeable membranes 24 are configured such fluid does not pass therethrough. The impermeable membranes 24 are coupled with the slats 22 such that when the slats 22 are expanded, the impermeable membranes 24 are also expanded or unfolded.

The fluid barrier 20 also includes a protrusion portion 26. The protrusion portion 26 can have a wider diameter than the rest of the fluid barrier 20 when the slats 24 are fully squeezed radially inward. In other examples, the protrusion portion 26 can have an equal or smaller diameter than the rest of the fluid barrier 20 when the slats 24 are fully squeezed radially inward. On the other hand, the protrusion portion 26 has a diameter smaller than the diameter of the inner bore 107 of the tubular housing 11. The end opposite the protrusion portion 26 is inserted into the inner bore 107 of the tubular housing 11 first. In other examples, the protrusion portion 26 can be inserted into the inner bore 107 of the tubular housing 11 first through the connection 1000.

Figure 3:
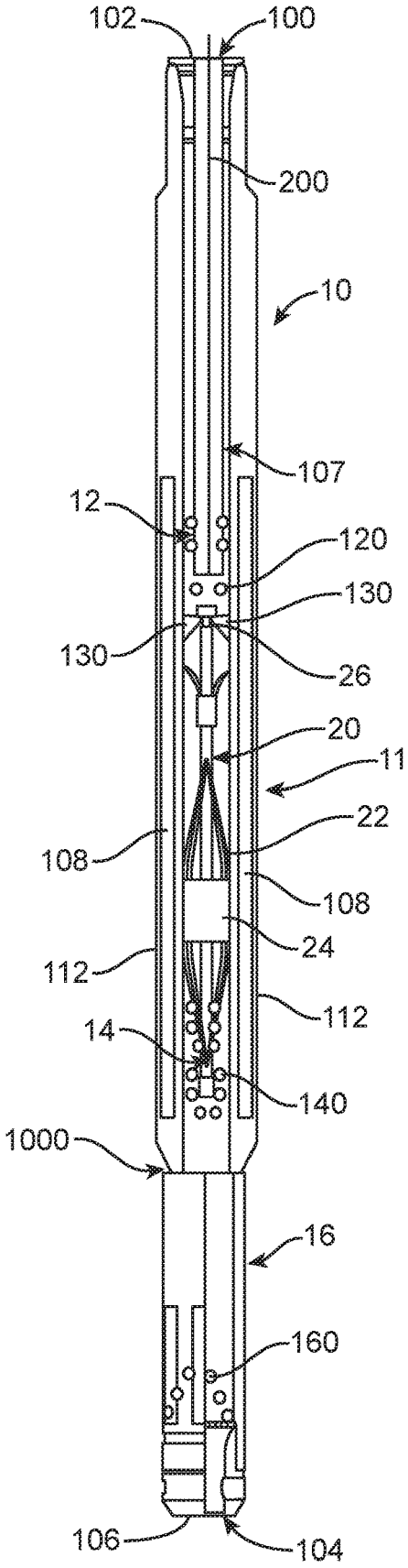
FIG. 3 is a diagram illustrating a fluid barrier being secured in a delivery device.

If the fluid barrier 20 is inserted into the delivery device 10 through the fluid entrance aperture 102, the fluid barrier 20 is secured within the delivery device 10 as shown in FIG. 3. A rod 200 is inserted into inner bore 107 through the fluid entrance aperture 102. The rod 200 shifts the fluid barrier 20 down into the delivery device 10. The conditional operator (s) 130 receive the protrusion portion 26 of the fluid barrier 20, securing the fluid barrier 20 between the first bypass port 12 and the second bypass port 14. In other examples, the fluid barrier 20 can be shifted down into the delivery device 10 without the use of a rod 200. In yet other examples, the fluid barrier 20 is received and secured within the delivery device 10 during manufacture of the delivery device 10.

Figure 4A:
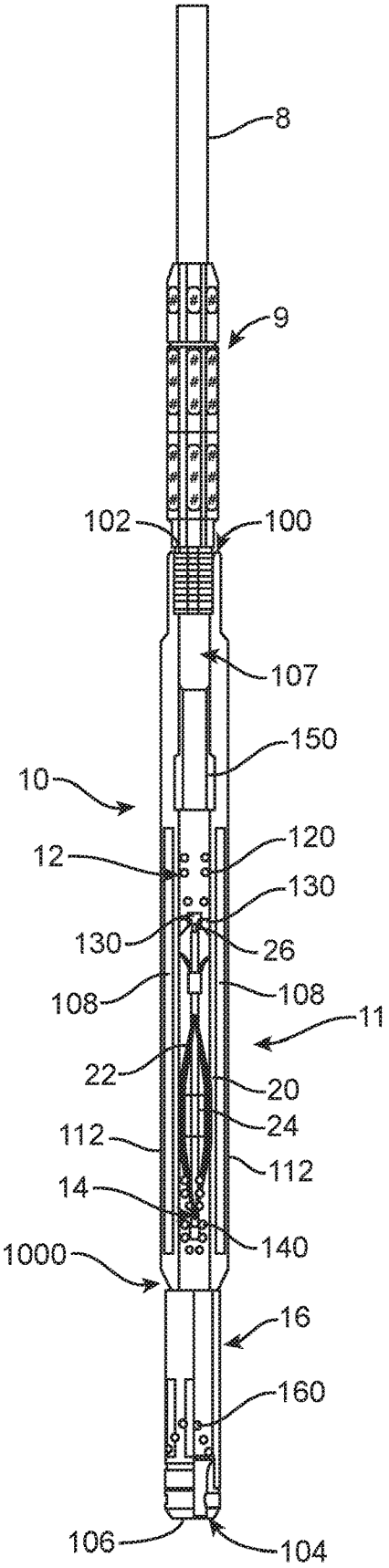
FIG. 4A is a diagram illustrating a delivery device coupled with a conveyance.

FIG. 4A illustrates the delivery device 10 coupled with a conveyance 8. A connector 9 can couple the delivery device 10 to the conveyance 8. The connector 9 can couple to the first end 100 of the delivery device 10 by threaded engagement. In other examples, the connector 9 can couple to the delivery device 10 by any suitable means such that the delivery device 10 is in fluid communication with the connector 9 and the conveyance 8. In yet other examples, the delivery device 10 can directly couple to the conveyance 8.

FIG. 4A also illustrates a sleeve 150 that is slidably received in the inner bore 107. The sleeve 150 is received in the inner bore 107 above the first bypass port 12. The sleeve 150 is secured above the first bypass port 12 until an activating force is imparted thereupon. The sleeve 150 can be secured above the first bypass port 12 by a coupling means such as shear pins, friction, or any suitable means. The activating force can be a predetermined force that releases the sleeve 150 such that the sleeve 150 slides down the inner bore 107.

While the delivery device 10 is coupled with the conveyance 8, the delivery device 10 can be run downhole. During that time, fluid can pass through the delivery device 10. Fluid can be any suitable wellbore fluid and can include any materials that are involved in downhole operation (shown in FIG. 6). Fluid can pass through the conveyance 8, through the connector 9 and into the inner bore 107 of the delivery device 10. The fluid can then pass through the first bypass port 12 into the bypass channel 108 and back into the inner bore 107 through the second bypass port 14, circumventing the fluid barrier 20. The fluid can then exit the delivery device 20 through either the fluid exit aperture 106 or the exit port 160. While the disclosure focuses on the above-mentioned path of the fluid flow, the fluid can pass through the delivery device 10 in a reversed path.

Figure 4B:
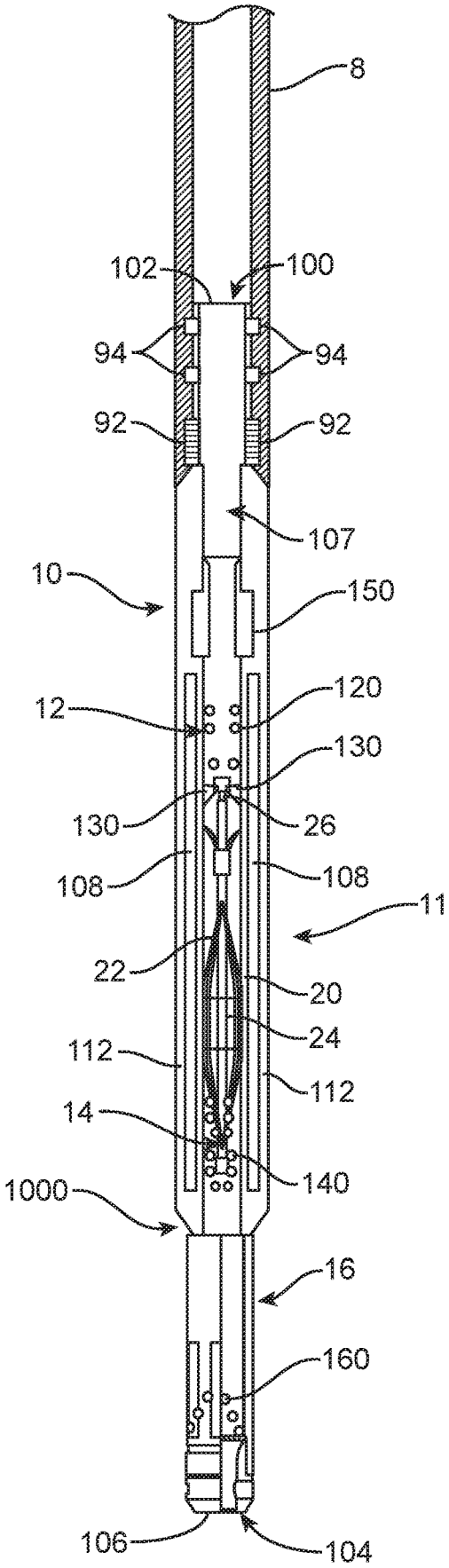
FIG. 4B is a diagram illustrating another embodiment of a delivery device coupled with a conveyance line.

In other examples, as illustrated in FIG. 4B, the delivery device 10 can be directly coupled to the conveyance 8. The delivery device 10 can include at least one fastening ring 92 and at least one slip 94 that couples and secures the delivery device 10 directly to the conveyance 8 without a connector.

Figure 5:
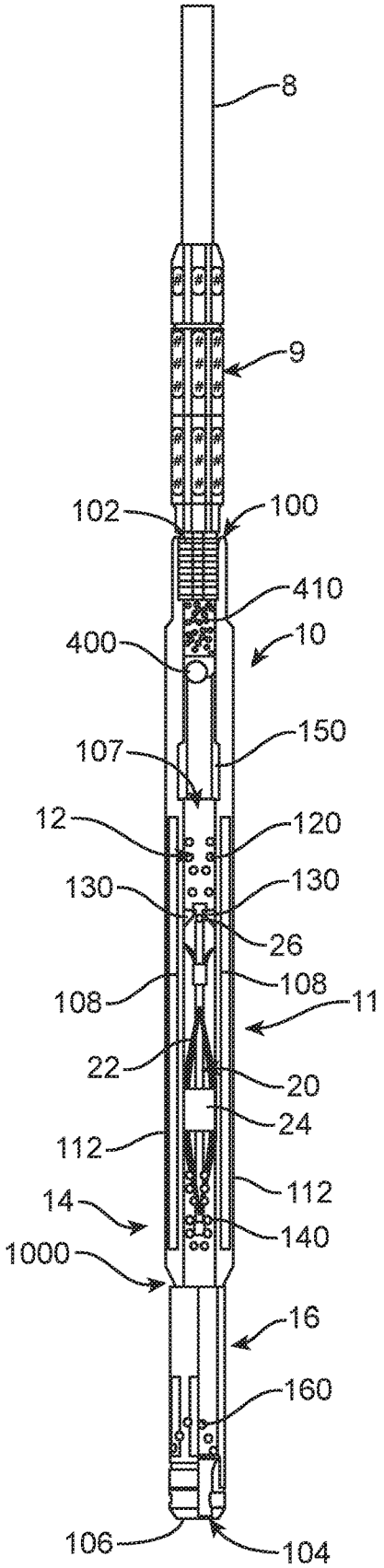
FIG. 5 is a diagram illustrating a delivery device being activated.

As illustrated in FIG. 5, when the delivery device 10 is at a predetermined position in the wellbore 5, a ball 400 is dropped into the delivery device 10 through the fluid entrance aperture 102 to activate the sleeve 150. The ball 400 can be any object, dart or other means to impart an activating force to the sleeve 150 such that the sleeve 150 slides down the inner bore 107. Plug or treatment fluid 410 flows down the conveyance 8, through the connector 9, and into the inner bore 107 of the delivery device 10 by the fluid entrance aperture 102. The plug or treatment fluid 410 flows behind the ball 400, urging the ball 400 downward. The plug or treatment fluid 410 can be cement or any other suitable fluid.

Figure 6:
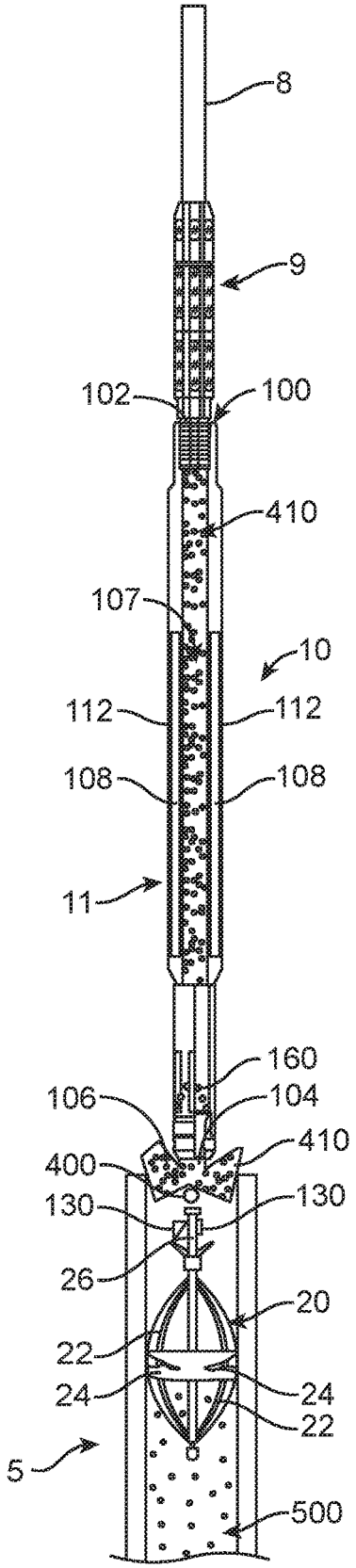
FIG. 6 is a diagram illustrating a fluid barrier shifted out of a delivery device.

The sleeve 150 shifts down through the inner bore 107 and imparts a breaking force on the conditional operator(s) 130. The conditional operator(s) 130 detaches from the tubular housing 11 upon receiving the breaking force. When the conditional operator(s) 130 detach from the tubular housing 11, the fluid barrier 20 is released as shown in FIG. 6. The fluid barrier 20 is shifted out of the delivery device 10 through the fluid exit aperture 106. The fluid barrier 20 can be shifted out of the delivery device 10 by the plug or treatment fluid 410 flowing down through the delivery device 10. Along with the fluid barrier 20, the conditional operator(s) 130 can also be shifted out of the delivery device 10.

When the fluid barrier 20 exits the delivery device 10 into the wellbore 5, the fluid barrier 20 expands. The slats 22 radially expand such that the slats 22 engage the sides of the wellbore 5, securing the fluid barrier 20 in the wellbore 5. In other examples, the fluid barrier 20 can engage the wellbore 5 by any suitable means to secure the fluid barrier 20 in place. When the slats 22 radially expand, the impermeable membranes 24 also expand and unfold to provide a barrier that is impermeable to fluid. The fluid barrier 20 is also supported by the fluid 500 that is already in the wellbore 5. Fluid 500 can be any suitable wellbore fluid and can include any materials that are involved with drilling, such as brine or salt water. As the impermeable membranes 24 are expanded, the fluid 500 remains below the fluid barrier 20 and provides support for the fluid barrier 20 in the wellbore 5.

Figure 7:
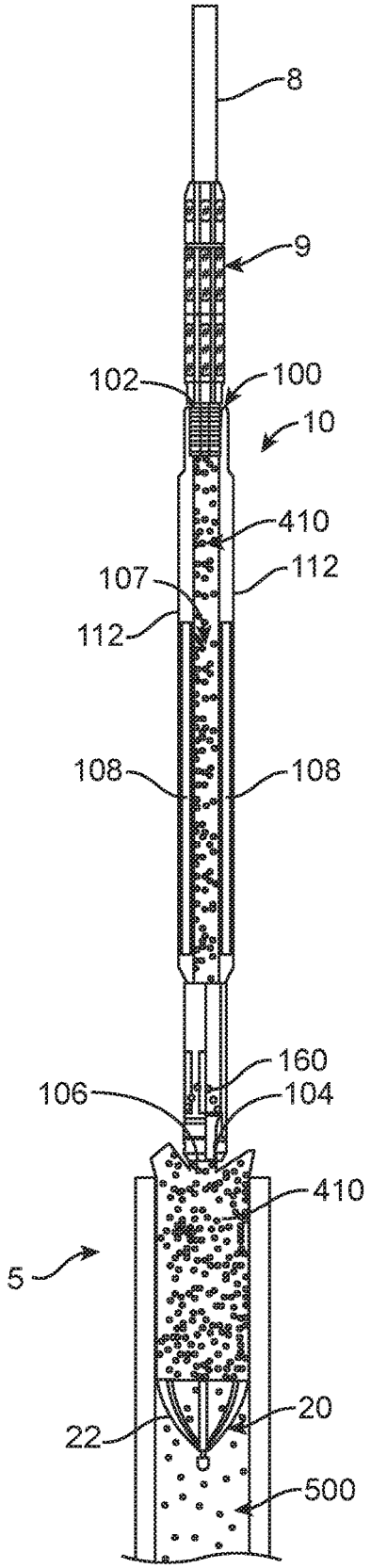
FIG. 7 is a diagram illustrating a fluid barrier supporting a fluid.

Plug or treatment fluid 410 flows out of the fluid exit aperture 106 of the delivery device 10 into the wellbore 5, as shown in FIG. 7. The fluid barrier 20 provides a barrier between the plug or treatment fluid 410 and the fluid 500 such that the plug fluid 410 maintains its positional integrity. The plug or treatment fluid 410 can remain substantially in place and can provide a seal or can remain uncontaminated from the fluid 500.

Figure 8:
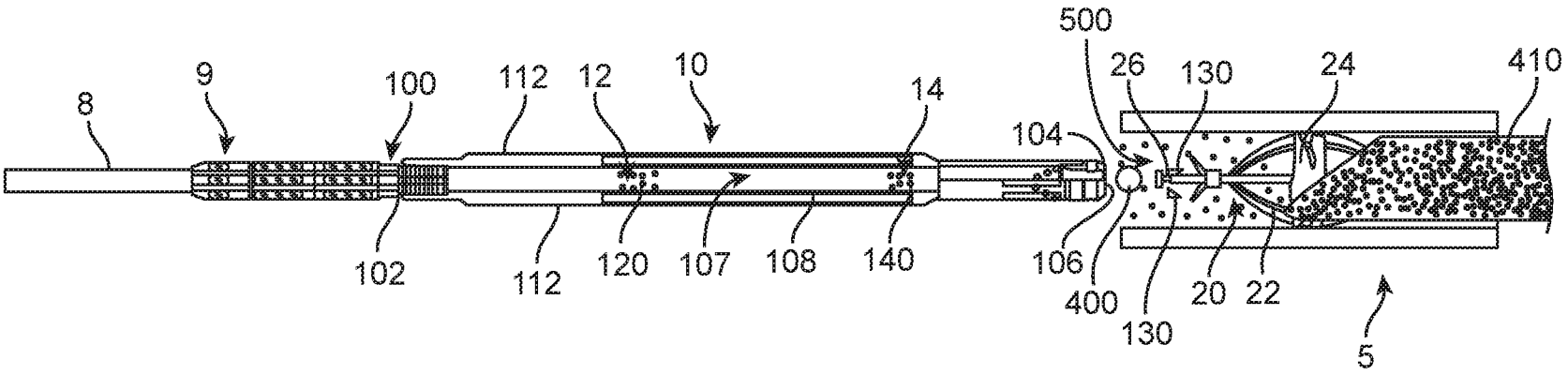
FIG. 8 is a diagram of a delivery device and a fluid barrier in a horizontal environment.

FIG. 8 illustrates an example of the delivery device 10 and the fluid barrier 20 used in a wellbore 5 that is substantially horizontal. In FIG. 8, plug or treatment fluid 410 is injected into the wellbore 5 before shifting the fluid barrier 20 out of the delivery device 10. The plug or treatment fluid 410 can pass through the conveyance 8, through the connector 9 and into the inner bore 107 of the delivery device 10. The plug or treatment fluid 410 can then pass through the first bypass port 12 into the bypass channel 108 and back into the inner bore 107 through the second bypass port 14, circumventing the fluid barrier 20. The plug or treatment fluid 410 can then exit the delivery device 20 through either the fluid exit aperture 106 or the exit port 160.

When a desired amount of plug or treatment fluid 410 is inserted into the wellbore 5, the ball 400 can be dropped to activate the sleeve (not shown). The sleeve shifts down the inner bore 107, imparting a breaking force to the conditional operator(s) 130, and shifting the fluid barrier 20 out of the delivery device 10. When shifted out of the delivery device 10 into the wellbore, the slats 22 of the fluid barrier 20 expand radially outward, also expanding the impermeable barriers 24 to provide a seal for the plug fluid 410. Other fluids such as fluid 500 then flow through the delivery device 10 into the wellbore 5 to provide support for the fluid barrier 20. As such, slump of the plug fluid 410 can be prevented to provide a competent plug.

Figure 9:
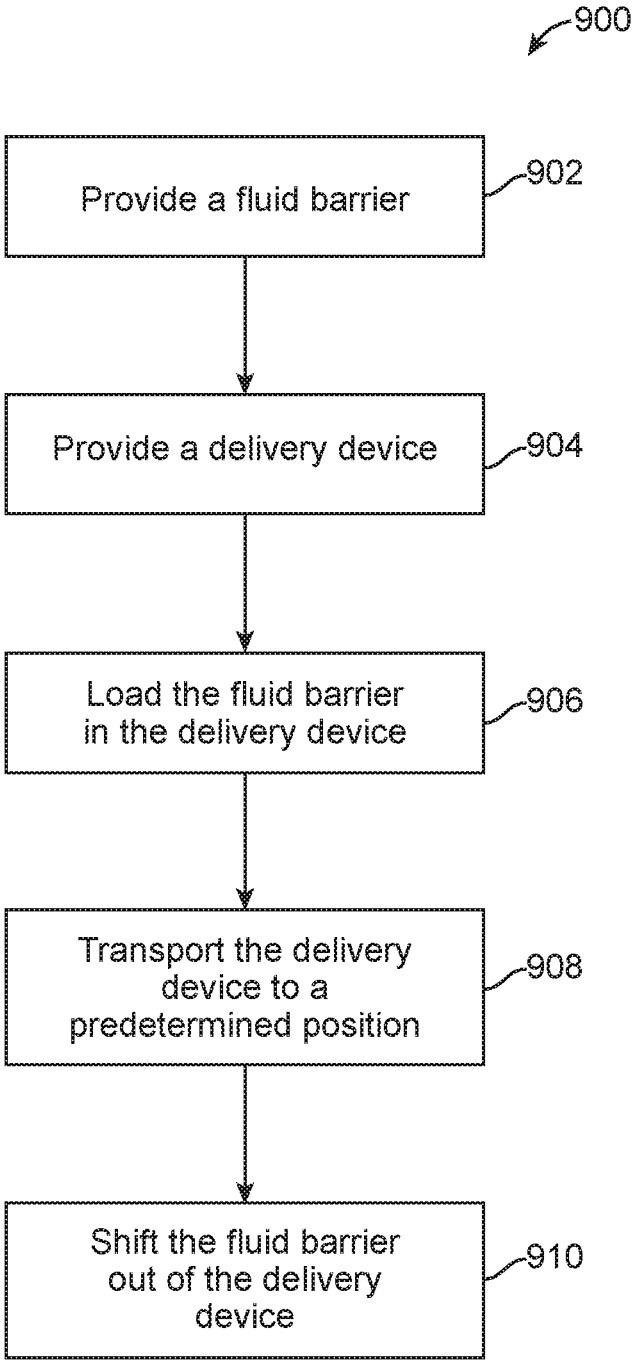
FIG. 9 is a flow chart of a method of delivering a fluid barrier.

Referring to FIG. 9, a flowchart is presented in accordance with an example embodiment. The method 900 is provided by way of example, as there are a variety of ways to carry out the method. The method 900 described below can be carried out using the configurations illustrated in FIGS. 1-8, for example, and various elements of these figures are referenced in explaining example method 900. Each block shown in FIG. 9 represents one or more processes, methods or subroutines, carried out in the example method 900. Furthermore, the illustrated order of blocks is illustrative only and the order of the blocks can change according to the present disclosure. Additional blocks may be added or fewer blocks may be utilized, without departing from this disclosure. The example method 900 can begin at block 902.

At block 902, a fluid barrier is provided. The fluid barrier includes a plurality of slats, at least one impermeable membrane, and a protrusion portion. The slats are configured to expand radially outward. In at least one example, the slats are spring loaded to expand radially outward. The impermeable membranes are configured to substantially prevent fluid from passing through. The impermeable membranes are coupled with the slats such that when the slats expand radially outward, the impermeable membranes expand or unfold.

At block 904, a delivery device is provided. The delivery device includes a tubular housing. The tubular housing includes an inner bore, a first bypass port, a second bypass port, and a bypass channel. The first bypass port and the second bypass port have a plurality of holes. The bypass channel extends along the length of the tubular housing between the outer surface of the tubular housing and the inner bore, where the inner bore and the bypass channel are separated by an impermeable barrier. The first bypass port permits fluid communication between the inner bore and a first end of the bypass channel while the second bypass port permits fluid communication between a second end of the bypass channel and the inner bore. A sleeve is also received in the inner bore and is slidable from a first position within the inner bore to a second position. The delivery device also includes at least one conditional operator within the inner bore between the first bypass port and the second bypass port that is configured to shear or detach from the inner bore when a breaking force is imparted thereupon.

At block 906, the fluid barrier is loaded in the delivery device. The fluid barrier can be loaded by a rod pushing the fluid barrier down the inner bore of the delivery device. The protrusion portion of the fluid barrier is received by conditional operator(s) such that the fluid barrier is secured between the first bypass port and the second bypass port. The fluid barrier is positioned such that fluid can flow from through the first bypass port, the bypass channel, and the second bypass port to circumvent fluid barrier.

At block 908, the delivery device with the fluid barrier is transported down a wellbore to a predetermined position. The delivery device is coupled with a conveyance and transported downhole.

At block 910, the fluid barrier is shifted out of the delivery device. A ball can be dropped down the conveyance to the inner bore. The ball imparts an activating force upon the sleeve, thereby activating the sleeve to slide from the first position to the second position. When the sleeve imparts a breaking force upon the conditional operator(s), the conditional operator(s) shear or detach from the inner bore. As the conditional operator(s) are not secured to the inner bore, the fluid barrier is shifted out of the delivery device. The fluid barrier can be shifted out of the delivery device through a fluid exit aperture. When the fluid barrier is shifted out of the delivery device into the wellbore, the fluid barrier expands and provides a seal.

Numerous examples are provided herein to enhance understanding of the present disclosure. A specific set of statements are provided as follows.

Statement 1: A downhole barrier delivery device comprising: a tubular housing having an outer surface, a first end having a fluid entrance aperture, a second end opposite the first end having a fluid exit aperture, and an inner bore extending from the fluid entrance aperture to the fluid exit aperture and having an inner surface; a bypass channel extending along a length of the tubular housing between the outer surface of the tubular housing and the inner surface of the inner bore, wherein the inner bore and the bypass channel are separated by an impermeable barrier; a first end of the bypass channel fluidly coupled with the inner bore via a first bypass port; and a second end of the bypass channel coupled with the inner bore via a second bypass port.

Statement 2: A downhole barrier delivery device is disclosed according to Statement 1, wherein the first and second bypass ports each comprise a plurality of holes.

Statement 3: A downhole barrier delivery device is disclosed according to Statement 1 or Statement 2, further comprising: a fluid barrier disposed within the inner bore and positioned between the first bypass port and the second bypass port thereby forcing fluid into the first or second bypass ports when fluid is pumped within the tubular housing; a sleeve slidable from a first position within the inner bore to a second position thereby shifting the fluid barrier out through the fluid exit aperture.

Statement 4: A downhole barrier delivery device is disclosed according to Statement 3, wherein the tubular housing further comprises at least one conditional operator, wherein the at least one conditional operator receives and secures the fluid barrier between the first and second bypass ports.

Statement 5: A downhole barrier delivery device is disclosed according to Statement 4, wherein the at least one conditional operator releases the fluid barrier when the sleeve slides from the first position to the second position.

Statement 6: A downhole barrier delivery device is disclosed according to Statements 4 or 5, wherein the at least one conditional operator are shear pins.

Statement 7: A downhole barrier delivery device is disclosed according to Statements 3-6, wherein the fluid barrier expands when shifted out through the fluid exit aperture.

Statement 8: A downhole barrier delivery device is disclosed according to Statements 3-7, wherein the fluid barrier comprises a plurality of slats.

Statement 9: A downhole barrier delivery device is disclosed according to Statement 8, wherein the plurality of slats is spring loaded to expand radially outward.

Statement 10: A downhole barrier delivery device is disclosed according to Statements 8 or 9, wherein the plurality of slats is tensioned to expand radially outward.

Statement 11: A downhole barrier delivery device is disclosed according to Statements 3-10, wherein the fluid barrier comprises at least one impermeable membrane.

Statement 12: A system for delivering a fluid barrier in a wellbore comprising: a downhole barrier delivery device coupled with a tubular conveyance string, the downhole barrier delivery device comprising: a tubular housing having an outer surface, a first end having a fluid entrance aperture, a second end opposite the first end having a fluid exit aperture and an inner bore extending from the fluid entrance aperture to the fluid exit aperture; a bypass channel extending along a length of the tubular housing between the outer surface of the tubular housing and the surface of the inner bore, wherein the inner bore and the bypass channel are separated by an impermeable barrier; a first end of the bypass channel fluidly coupled with the inner bore via a first bypass port; a second end of the bypass channel coupled with the inner bore via a second bypass port; a fluid barrier disposed within the inner bore and positioned between the first bypass port and the second bypass port thereby forcing fluid into the first or second bypass ports when fluid is pumped within the tubular housing; and a sleeve slidable from a first position within the inner bore to a second position thereby shifting the fluid barrier out of the fluid exit aperture.

Statement 13: A system is disclosed according to Statement 12, wherein the first and second bypass ports each comprise a plurality of holes.

Statement 14: A system is disclosed according to Statements 12 or 13, wherein the tubular housing further comprises at least one conditional operator, wherein the at least one conditional operator receives and secures the fluid barrier.

Statement 15: A system is disclosed according to Statement 14, wherein the at least one conditional operator releases the fluid barrier when the sleeve slides from the first position to the second position.

Statement 16: A system is disclosed according to Statement 15, wherein the at least one conditional operator are at least one of shear pins, lock rings, or collets.

Statement 17: A system is disclosed according to Statements 12-16, wherein the fluid barrier expands when shifted out through the fluid exit aperture.

Statement 18: A system is disclosed according to Statement 17, wherein the fluid barrier comprises a plurality of slats.

Statement 19: A system is disclosed according to Statement 18, wherein the plurality of slats is spring loaded to expand radially outward.

Statement 20: A system is disclosed according to Statement 18, wherein the plurality of slats is tensioned to expand radially outward.

Statement 21: A system is disclosed according to Statements 12-20, wherein the fluid barrier comprises at least one impermeable membrane.

Statement 22: A system is disclosed according to Statements 12-21, wherein the tubular conveyance string is coiled tubing.

Statement 23: A method for delivering a fluid barrier comprising: introducing a downhole barrier delivery device into a wellbore, the downhole barrier delivery device comprising: a tubular housing having an outer surface, a first end having a fluid entrance aperture, a second end opposite the first end having a fluid exit aperture, and an inner bore extending from the fluid entrance aperture to the fluid exit aperture; a bypass channel extending along a length of the tubular housing between the outer surface of the tubular housing and the surface of the inner bore, wherein the inner bore and the bypass channel are separated by an impermeable barrier; a first end of the bypass channel fluidly coupled with the inner bore via a first bypass port; and a second end of the bypass channel coupled with the inner bore via a second bypass port; and a sleeve slidable from a first position within the inner bore to a second position; loading a fluid barrier into the downhole barrier delivery device between the first and second bypass ports; transporting the downhole barrier delivery device with the fluid barrier to a predetermined position; and activating the sleeve to slide from the first position to the second position thereby shifting the fluid barrier out of the fluid exit aperture.

Statement 24: A method is disclosed according to Statement 23, wherein the sleeve is activated by imparting an activating force thereupon.

Statement 25: A method is disclosed according to Statement 24, wherein the activating force is imparted on the sleeve by a ball.

Statement 26: A method is disclosed according to Statements 23-25, wherein the tubular housing comprises at least one conditional operator that receives and secures the fluid barrier between the first and second bypass ports; wherein after activating the sleeve, the sleeve imparts a breaking force on the at least one conditional operator to release the fluid barrier.

Statement 27: A method is disclosed according to Statements 23-26, further comprising: passing a fluid through the tubular housing, wherein the fluid passes through the first and second bypass ports and the bypass channel, circumventing the fluid barrier.

Statement 28: A method is disclosed according to Statement 27, wherein the fluid is cement or treatment fluid.

Statement 29: A method is disclosed according to Statements 27 or 28, wherein the fluid is wellbore fluid.

Statement 30: A method is disclosed according to Statements 23-29, wherein the fluid barrier expands when shifted out of the downhole barrier delivery device.

Statement 31: A method is disclosed according to Statements 23-30, wherein the fluid barrier comprises at least one impermeable membrane.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A downhole barrier delivery device comprising:

a tubular housing having an outer surface, a first end having a fluid entrance aperture, a second end opposite the first end having a fluid exit aperture, and an inner bore extending from the fluid entrance aperture to the fluid exit aperture and having an inner surface;

a bypass channel extending along a length of the tubular housing between the outer surface of the tubular housing and the inner surface of the inner bore, wherein the inner bore and the bypass channel are separated by an impermeable barrier;

a first end of the bypass channel fluidly coupled with the inner bore via a first bypass port;

a second end of the bypass channel coupled with the inner bore via a second bypass port;

a fluid barrier disposed within the inner bore and positioned between the first bypass port and the second bypass port thereby forcing fluid into the first or second bypass ports when fluid is pumped within the inner bore; and a sleeve slidable from a first position within the inner bore to a second position thereby shifting the fluid barrier out through the fluid exit aperture.

2. The downhole barrier delivery device of claim 1, wherein the first and second bypass ports each comprise a plurality of holes.

3. The downhole barrier delivery device of claim 1, wherein the tubular housing further comprises at least one conditional operator, wherein the at least one conditional operator receives and secures the fluid barrier between the first and second bypass ports.

4. The downhole barrier delivery device of claim 3, wherein the at least one conditional operator releases the fluid barrier when the sleeve slides from the first position to the second position.

5. The downhole barrier delivery device of claim 1, wherein the fluid barrier expands when shifted out through the fluid exit aperture.

6. The downhole barrier delivery device of claim 1, wherein the fluid barrier comprises at least one impermeable membrane.

7. A system for delivering a fluid barrier in a wellbore comprising:

a downhole barrier delivery device coupled with a downhole tubular conveyance string, the downhole barrier delivery device comprising:

a tubular housing having an outer surface, a first end having a fluid entrance aperture, a second end opposite the first end having a fluid exit aperture, and an inner bore extending from the fluid entrance aperture to the fluid exit aperture;

a bypass channel extending along a length of the tubular housing between the outer surface of the tubular housing and the surface of the inner bore, wherein the inner bore and the bypass channel are separated by an impermeable barrier;

a first end of the bypass channel fluidly coupled with the inner bore via a first bypass port;

a second end of the bypass channel coupled with the inner bore via a second bypass port;

a fluid barrier disposed within the inner bore and positioned between the first bypass port and the second bypass port thereby forcing fluid into the first or second bypass ports when fluid is pumped within the tubular housing; and a sleeve slidable from a first position within the inner bore to a second position thereby shifting the fluid barrier out of the fluid exit aperture.

8. The system of claim 7, wherein the first and second bypass ports each comprise a plurality of holes.

9. The system of claim 7, wherein the tubular housing further comprises at least one conditional operator, wherein the at least one conditional operator receives and secures the fluid barrier.

10. The system of claim 9, wherein the at least one conditional operator releases the fluid barrier when the sleeve slides from the first position to the second position.

11. The system of claim 7, wherein the fluid barrier expands when shifted out through the fluid exit aperture.

12. The system of claim 7, wherein the fluid barrier comprises at least one impermeable membrane.

13. The system of claim 7, wherein the tubular conveyance string is coiled tubing or joint tubing.

14. A method for delivering a fluid barrier comprising:

introducing a downhole barrier delivery device into a wellbore, the downhole barrier delivery device comprising:

a tubular housing having an outer surface, a first end having a fluid entrance aperture, a second end opposite the first end having a fluid exit aperture, and an inner bore extending from the fluid entrance aperture to the fluid exit aperture;

a bypass channel extending along a length of the tubular housing between the outer surface of the tubular housing and the surface of the inner bore, wherein the inner bore and the bypass channel are separated by an impermeable barrier;

a first end of the bypass channel fluidly coupled with the inner bore via a first bypass port; and a second end of the bypass channel coupled with the inner bore via a second bypass port; and a sleeve slidable from a first position within the inner bore to a second position;

loading a fluid barrier into the downhole barrier delivery device between the first and second bypass ports;

transporting the downhole barrier delivery device with the fluid barrier to a predetermined position; and activating the sleeve to slide from the first position to the second position thereby shifting the fluid barrier out of the fluid exit aperture.

15. The method of claim 14, wherein the sleeve is activated by imparting an activating force thereupon.

16. The method of claim 15, wherein the activating force is imparted on the sleeve by a ball or dart.

17. The method of claim 14, wherein the tubular housing comprises at least one conditional operator that receives and secures the fluid barrier between the first and second bypass ports; wherein after activating the sleeve, the sleeve imparts a breaking force on the at least one conditional operator to release the fluid barrier.

18. The method of claim 14, further comprising: passing a fluid through the tubular housing, wherein the fluid passes through the first and second bypass ports and the bypass channel, circumventing the fluid barrier.

19. The method of claim 14, wherein the fluid barrier expands when shifted out of the downhole barrier delivery device.

* * * * *